US007878898B2

(12) United States Patent
Toyoda

(10) Patent No.: US 7,878,898 B2
(45) Date of Patent: Feb. 1, 2011

(54) GAMING MACHINE

(75) Inventor: Hirobumi Toyoda, Tokyo (JP)

(73) Assignee: Universal Entertainment Corporation, Tokyo (JP)

( * ) Notice: Subject to any disclaimer, the term of this patent is extended or adjusted under 35 U.S.C. 154(b) by 804 days.

(21) Appl. No.: 11/902,119

(22) Filed: Sep. 19, 2007

(65) Prior Publication Data

US 2008/0076562 A1 Mar. 27, 2008

(30) Foreign Application Priority Data

Sep. 22, 2006 (JP) ..... 2006-258106

(51) Int. Cl.
*A63F 9/24* (2006.01)

(52) U.S. Cl. ..... 463/20; 463/27; 463/31; 463/46

(58) Field of Classification Search ..... 463/20, 463/27, 31, 46; 119/245
See application file for complete search history.

(56) References Cited

U.S. PATENT DOCUMENTS 5,857,910 A * 1/1999 Watanabe et al. ..... 463/17
2004/0018865 A1* 1/2004 Gilmore et al. ..... 463/7

FOREIGN PATENT DOCUMENTS

JP 2001-046583 A 2/2001
JP 2005-230190 A 9/2005
JP 2006-141634 A 6/2006

* cited by examiner

*Primary Examiner*—Peter DungBa Vo
*Assistant Examiner*—Omkar Deodhar
(74) *Attorney, Agent, or Firm*—Arent Fox LLP

(57) ABSTRACT

A gaming machine includes: a CPU 106 which determines whether or not the game state is to be switched to a special game state advantageous to the player; mechanical reels 30A through 30C formed of a translucent material and operative to display multiple kinds of indicating information variably and statically; a motor driving circuit 120 which controls the display operation of the mechanical reels 30A through 30C; a water tank 500 formed of a translucent material and provided behind a display screen 10 to retain liquid; an acid/base solution supply device 710 which injects a substance, which is capable of changing the color of the liquid stored in the water tank 500, into the liquid; and a drive control circuit 300 which controls the acid/base solution supply device 710 according to the determination made by the CPU 106.

4 Claims, 10 Drawing Sheets

FIG. 7

WATER TANK VISUAL EFFECT PATTERN TABLE

| PROBABILITY THAT GAME STATE WILL TRANSIT TO ADVANTAGEOUS GAME STATE (%) | THE NUMBER OF INSTANCES OF INJECTION OF SUBSTANCE (TIMES) | DISTANCE BY WHICH LIQUID STORAGE UNIT IS TO BE MOVED (RATIO) |
|---|---|---|
| 100 | 3 | 100 |
| 80 | 2 | 80 |
| 30 | 1 | 30 |

GAMING MACHINE

This application is based on and claims the benefit of priority from Japanese Patent Application No. 2006-258106, filed on 22 Sep. 2006, the content of which is incorporated herein by reference.

BACKGROUND OF THE INVENTION

1. Field of the Invention

The present invention relates to a gaming machine such as a slot machine, a pachinko-style slot machine, and a pachinko machine.

2. Related Art

With conventional gaming machines (slot machines), upon the player manipulating an operating means (start lever) after the insertion of a predetermined number of units of a gaming medium (coins or the like), a display means (reels or a liquid crystal display device), which displays multiple indicating information on the outer face thereof in the form of multiple lines (e.g., in the form of a 3×3 matrix), begins to scroll.

Furthermore, such gaming machines provide the following game. That is to say, upon the player operating the start lever, reels or the like are rotated a predetermined number of times (for a predetermined period of time), following which the rotation thereof is stopped. Then, such a gaming machine pays out an amount of coins based upon the combination of the indicating information rearranged along an active pay line provided to the display means that allows the player to recognize the indicating information.

In addition, in recent years, various ideas have been proposed for improving visual effects. For example, an idea has been proposed for the aforementioned gaming machines, in which a hollow container filled with a liquid is provided forward of a lower panel of a cabinet of the slot machine. With such an arrangement, movable members such as simulated aquatic plants, simulated fishes, etc., are provided within the hollow container. Furthermore, a bubble generator is provided to the hollow container, which provides bubbles into the liquid thus stored (see Patent Document 1).

With the gaming machine disclosed in Patent Document 1, the bubble generator provides bubbles into the liquid according to the progress and situations of the game, thereby providing improved visual effects.

However, with the gaming machine disclosed in Patent Document 1, such components are mounted at a different location from that of the display means, which allows the player to recognize the indicating information of variable display, leading to a problem that such components do not attract much attention from the player. In order to solve this problem, a gaming machine is proposed in which a water tank is provided forward of the display means that allows the player to recognize the indicating information of variable display displayed thereon. Such an arrangement provides improved visual effects, examples of which include bubbles provided within the water tank, visual effects provided by a transparent liquid crystal display device provided between the water tank and the display means, etc. (see Patent Documents 2 and 3).

With the gaming machines disclosed in Patent Documents 2 and 3, the water tank is provided forward of the display means that allows the player to recognize the indicating information of variable display displayed thereon. Such an arrangement allows the player to recognize the indicating information of variable display displayed on the display means while viewing the visual effects provided by the water tank. Thus, such visual effects attract the player's attention.

[Patent Document 1]

Japanese Unexamined Patent Application, First Publication No. 2001-46583

[Patent Document 2]

Japanese Unexamined Patent Application, First Publication No. 2005-230190

[Patent Document 3]

Japanese Unexamined Patent Application, First Publication No. 2006-141634

However, there is a problem with the gaming machines disclosed in Patent Documents 2 and 3, which have a structure in which the water tank is provided forward of the display means. That is to say, with such an arrangement, the information provided by the display means is thus displayed to the player through the medium of the water tank. In some cases, if something interrupts the player's view, or if there is a large distance between the display means and the player, the player cannot recognize the information displayed by the display means. Such a problem limits the permissible size and shape of the water tank, leading to such a water tank providing only limited visual effects.

The present invention has been made in view of the aforementioned problem. It is an object of the present invention to provide a gaming machine having improved visual effects by using a water tank, while facilitating the player's ability to visually recognize the information displayed by the display means.

SUMMARY OF THE INVENTION

In order to achieve the aforementioned purpose, the present invention provides the following arrangements.

In a first aspect of the present invention, a gaming machine includes: an operating means for allowing a player to operate the gaming machine; a game control means having a function whereby, upon the player performing an operation on the operating means, determination is made whether or not a game state is to be switched to a special game state advantageous to the player; a display means for displaying multiple kinds of indicating information variably and statically that is formed of a translucent material; a display control means for controlling, according to the determination made by the game control means, a display operation of the display means for displaying the indicating information variably and statically; a water tank which is provided behind a display screen for displaying the indicating information provided by the display means, retains liquid, and is formed of a translucent material; an injection means for injecting a substance, which is capable of changing the color of the liquid stored in the water tank, into the liquid; and a drive control means for controlling the injection means according to the determination made by the game control means.

According to the first aspect of the invention, when the player performs an operation on the operating means, the game control means determines whether or not the game state is to be switched to a game state advantageous to the player. The display means formed of a translucent material provides a function of displaying multiple kinds of indicating information variably and statically. According to the determination made by the game control means, the display control means controls the display operation of the display means for displaying the indicating information variably and statically. The water tank, which retains liquid and is formed of a translucent material, is provided behind the display screen for displaying the indicating information provided on the display means.

With such an arrangement, the drive control means controls, according to the determination made by the game control means, the injection means for injecting a substance, which is capable of changing the liquid stored in the water tank, into the liquid.

With such an arrangement, the water tank, which retains liquid, is provided behind the display means, which displays the multiple kinds of indicating information variably and statically. Such an arrangement allows the player to simultaneously recognize the multiple kinds of indicating information displayed by the display means via the display screen and the water tank provided behind the display screen. Furthermore, there is no need to take into account a concern of whether or not the water tank interrupts the player's view of the display screen that displays the indicating information provided on the display means (e.g., the reels or liquid crystal display device). Thus, with such an arrangement, the depth dimension of the water tank can be greater when compared with an arrangement in which the water tank is provided forward of the display means. Various kinds of items which provide visual effects (e.g., simulated pirate ships, simulated tropical fish, and simulated aquatic plants, all of which can be moved by magnetic force) can be arranged within such a water tank thus designed.

Furthermore, with such an arrangement, the indicating information provided by the display means are displayed variably and statically according to the determination made by the game control means of whether or not the game state is to be switched to the special game state advantageous to the player. Moreover, such an arrangement allows the color of the liquid stored in the water tank to be changed according this determination.

For example, an acid-base indicator is dissolved in the liquid stored in the water tank. The injection means inserts an acid solution or a base solution into the liquid stored in the water tank, thereby changing the color of the liquid stored in the water tank. Thus, with such an arrangement, visual effects, including the display of indicating information variably and statically, and the change in the color of the liquid stored in the water tank, are displayed in a superimposed manner. The player is thus notified that the game state will transit to a special game state advantageous to the player, which is of great interest to the player. This provides improved visual effects when using the water tank.

Thus, such an arrangement provides improved visual effects when using the water tank, while facilitating the player's ability to visually recognize the information displayed by the display means.

In a second aspect of the gaming machine as described in the first aspect of the present invention, the drive control means may instruct the injection means to inject the substance, which is capable of changing the color of the liquid stored in the water tank, into the liquid in stages.

According to the second aspect of the invention, the drive control means instructs the injection means to inject a substance, which is capable of changing the color of the liquid stored in the water tank, into the liquid in stages.

Such an arrangement allows the color of the liquid stored in the water tank to be changed multiple times. Thus, such an arrangement provides a function of changing the color of the liquid stored in the water tank multiple times according to the determination of whether or not the game state is to be switched to a special game state advantageous to the player.

For example, an acid-base indicator is dissolved in the liquid stored in the water tank. The injection means injects an acid solution or a base solution into the water tank. The storage means is provided for storing a color change table that specifies the correspondence between the probability that the game state will transit to the advantageous game state, which is used in the random number lottery processing, and the number of instances of the injection of an acid solution or a base solution. With such an arrangement, the game control means determines by random number lottery whether or not the game state is to be switched to a special game state advantageous to the player, upon which the drive control means performs a control operation which instructs the injection means to inject an acid solution or a base solution into the liquid stored in the water tank in stages according to the determination of whether or not the game state is to be switched to a special game state advantageous to the player with reference to the color change table. In the color change table, the number of instances of the injection of an acid solution or a base solution is proportional to the probability that the game state will transit to the advantageous game state. With such an arrangement, the number of instances of the change in the color of the liquid stored in the water tank is increased as the probability that the game state will transit to the advantageous game state becomes higher. With such an arrangement, the number of instances of the change in the color of the liquid stored in the water tank further enhances the player's sense of expectation with respect to the game state transition to the special game state advantageous to the player.

Thus, such an arrangement provides improved visual effects by using the water tank, while facilitating the player's ability to visually recognize the information displayed by the display means.

In a third aspect of the gaming machine as described in the first or second aspect of the present invention, the gaming machine may further include: a liquid storage means, which is movably provided within the water tank such that it partitions the water tank so as to section off a part of the liquid stored in the water tank, for storing the part of the liquid thus sectioned off; a movement control means for controlling the movement of the liquid storage means; and a communicating means for allowing the injection means and the liquid storage means to communicate with each other. With such an arrangement, the movement control means may control the movement of the liquid storage means according to the determination made by the game control means.

According to the third aspect of the invention, the liquid storage means is movably provided such that it partitions the water tank so as to section off a part of the liquid stored in the water tank, thereby storing the part of the liquid thus sectioned off. Furthermore, the liquid storage means is provided such that it communicates with the injection means via the communicating means. The movement control means controls the movement of the liquid storage means according to the determination made by the game control means.

Such an arrangement allows the color of the liquid stored within the liquid storage means to be changed. In addition, such an arrangement allows the liquid storage means to be moved. Thus, such an arrangement provides a function of changing the color of the liquid stored in the liquid storage means and moving the liquid storage means storing the liquid in the color thus changed, according to the determination of whether or not the game state is to be switched to a special game state advantageous to the player.

For example, an acid-base indicator is dissolved in the liquid stored in the water tank. The injection means injects an acid solution or a base solution into the liquid storage means. The storage means is provided for storing a visual effect pattern table that specifies the correspondence between the probability that the game state will transit to the advantageous game state, which is used in the random number lottery processing, the number of instances of the injection of an acid solution or a base solution, and the movement pattern of the liquid storage means. With such an arrangement, the game control means determines by random number lottery whether or not the game state is to be switched to a special game state advantageous to the player, upon which the drive control means performs a control operation which instructs the injection means to inject an acid solution or a base solution into the liquid stored in the water tank in stages according to the determination of whether or not the game state is to be switched to a special game state advantageous to the player with reference to the visual effect pattern table. Furthermore, the movement control means performs a control operation which moves the liquid storage means according to the movement pattern determined with reference to the visual effect pattern table according to the determination of whether or not the game state is to be switched to a special game state advantageous to the player. With such an arrangement, the number of instances of the change in the color of the liquid stored in the water tank and the position of the liquid storage means storing the liquid in this color thus changed further enhances the player's sense of expectation with respect to the game state transition to the special game state advantageous to the player.

Thus, such an arrangement provides improved visual effects by using the water tank, while facilitating the player's ability to visually recognize the information displayed by the display means.

According to the present invention, a water tank, which retains liquid, is provided behind a display screen for displaying indicating information provided by a display means which has a function of displaying multiple kinds of indicating information variably, and is formed of a translucent material. A drive control means controls, according to the determination made by the game control means, an injection means which has a function of injecting a substance that is capable of changing the color of the liquid stored in the water tank.

Thus, such an arrangement provides improved visual effects by using the water tank, while facilitating the player's ability to visually recognize the information displayed by the display means.

BRIEF DESCRIPTION OF THE DRAWINGS

FIG. 7 is a diagram showing a water tank visual effect pattern table according to the first embodiment of the present invention;

DETAILED DESCRIPTION OF THE INVENTION

A detailed description is provided below regarding embodiments of the present invention.

First Embodiment

Figure 1:
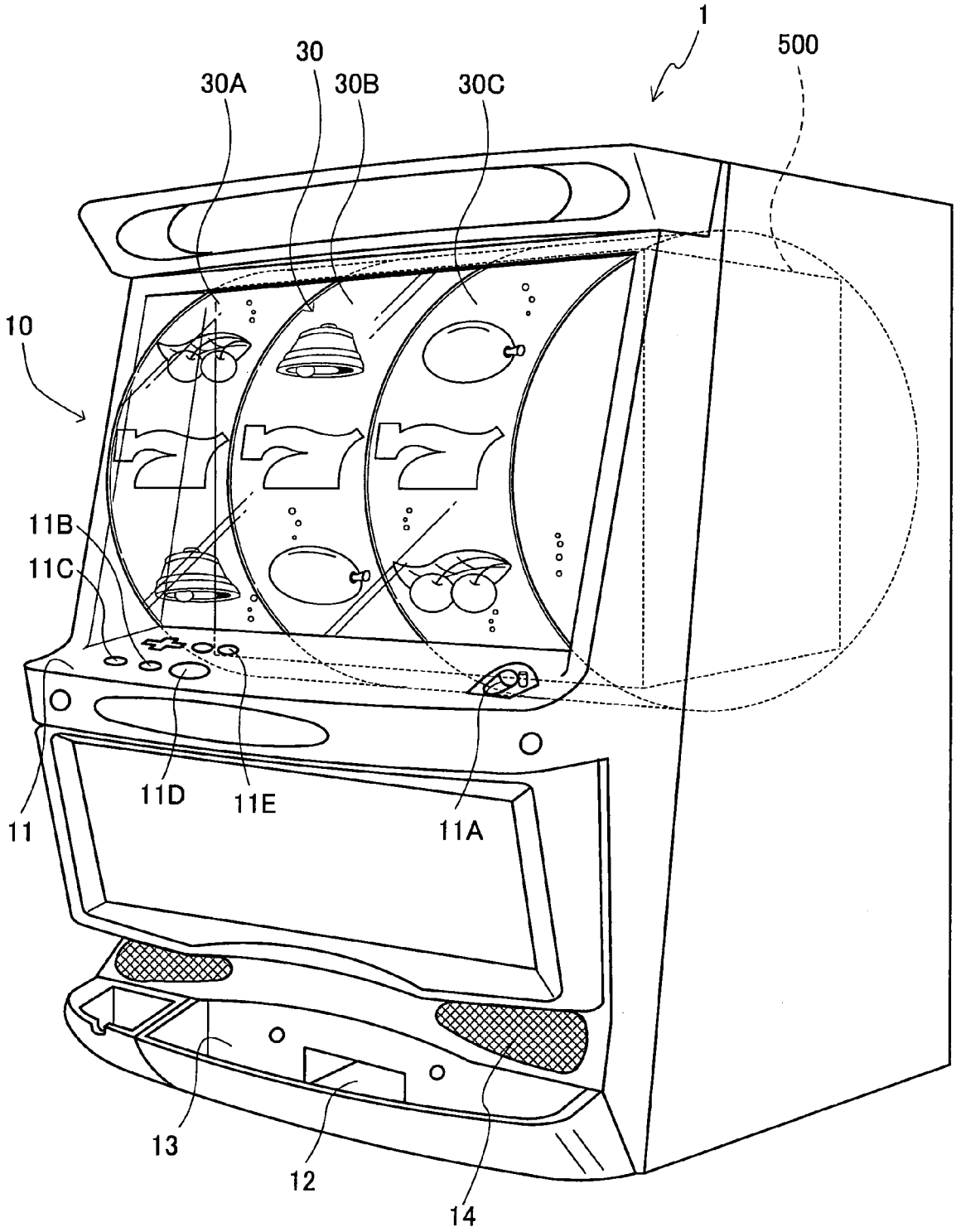
FIG. 1 is a perspective view showing the exterior of a slot machine according to a first embodiment of the present invention.

FIG. 1 is a perspective view showing the exterior of a slot machine 1 according to a first embodiment of the present invention. The slot machine 1 according to the embodiment of the present invention includes a reel group 30, an operation panel 11, a coin payout opening 12, a coin tray 13, and a sound output unit 14. It should be noted that slot machines can be roughly classified into two types. One is a slot machine having a configuration in which mechanical reels are rotated. The other is a so-called video slot machine having a configuration in which multiple virtual reels are rotated in the form of an image displayed on a screen. While a description is provided in the present embodiment regarding a slot machine employing mechanical reels, the present invention may also be applied to a video slot machine.

The slot machine 1 is installed at a predetermined location in an amusement facility such as a casino, etc. Furthermore, the slot machine 1 includes a control device 100 (see FIG. 5) or the like mounted therewithin for electrically controlling each component thereof. A description is provided later regarding the control device 100.

The reel group 30 has a structure in which three cylindrical mechanical reels 30A through 30C are rotatably disposed along a horizontal line. Furthermore, the mechanical reels 30A through 30C are disposed such that they can rotate around the circumference of a water tank 500. Multiple kinds of indicating information are provided on the outer face of each of the mechanical reels 30A through 30C. Such an arrangement displays the indicating information variably and statically on a display screen 10 that allows the player to recognize the indicating information. The multiple kinds of indicating information include a "red 7" design, a "blue 7" design, a "BAR" design, a "bell" design, a "watermelon" design, and a "cherry" design. Here, each of the three mechanical reels 30A through 30C is formed of a translucent material.

In other words, the mechanical reels 30A through 30C provide a function of displaying the multiple kinds of indicating information variably and statically. That is to say, the mechanical reels 30A through 30C serve as an example of a display means formed of a translucent material. Furthermore, each of the mechanical reels 30A through 30C is formed in a cylindrical shape, on the outer face of which are depicted multiple kinds of indicating information. Each reel is provided such that it can be rotated around the circumference of the water tank.

The operation panel 11 includes a coin insertion opening 11A which allows the player to insert coins into the slot machine 1. Furthermore, the operation panel 11 includes a BET switch 11B which allows the player to select the number of coins, which serve as the units of the gaming medium used in the game by the player. Moreover, the operation panel 11 includes a spin repeat BET switch 11C which allows the player to play the game again without changing the number of coins to be spent in the game from that in the immediately previous game. The slot machine 1 allows the player to set the number of coins to be spent in the game by performing a pushing operation on either the BET switch 11B or the spin repeat BET switch 11C.

Furthermore, the operation panel 11 includes a start switch 11D, which is a game start instruction receiving means that allows the player to input the game start instruction in increments of games. With the slot machine 1, upon the player performing a pushing operation on either the spin repeat BET switch 11C or the start switch 11D, a start operation signal is transmitted to a CPU 106 (see FIG. 5) described later. This starts the game, upon which a scrolling operation is performed for the reel group 30.

Furthermore, the operation panel 11 includes a payout switch 11E. Upon the player performing a pushing operation on the payout switch 11E, the coins inserted by the player are paid out via the coin payout opening 12. The coins to be paid out are retained in the coin tray 13.

Figure 2:
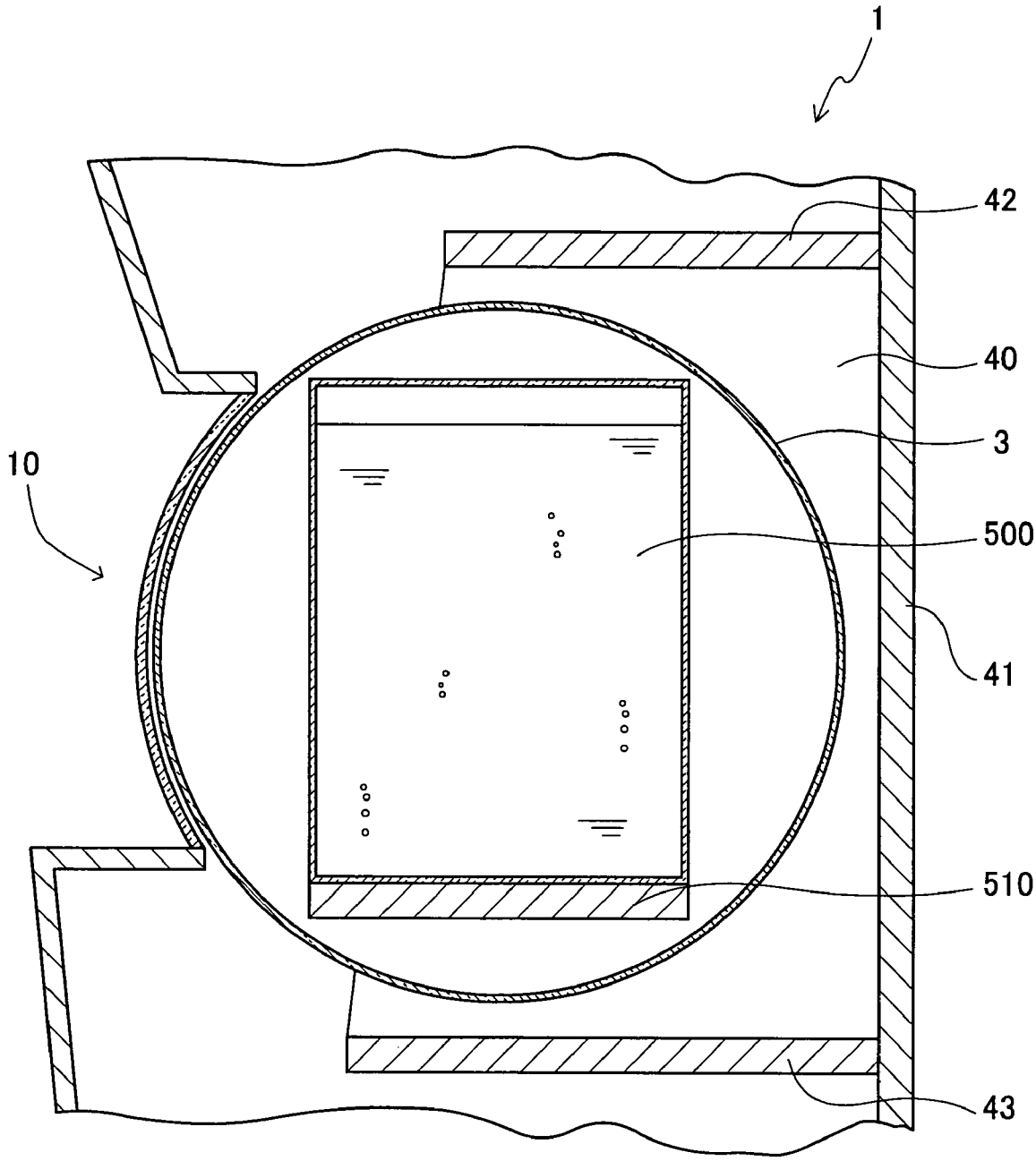
FIG. 2 is a cross-sectional view showing a reel group and a water tank included in the slot machine according to the first embodiment of the present invention.

FIG. 2 is a cross-sectional view showing the reel group 30 and the water tank 500 included in the slot machine 1 according to the first embodiment of the present invention.

Each of the mechanical reels 30A through 30C is independently rotatably supported by a reel frame 40. It should be noted that an unshown stepping motor is provided to the reel frame 40 for rotating each of the mechanical reels 30A through 30C, and a function of stopping the rotation thereof. The reel frame 40 is disposed between an upper frame 42 and a lower frame 43 provided to a main frame 41.

The water tank 500 is provided in the space within the three cylindrical mechanical reels 30A through 30C, and is supported by the cabinet of the slot machine 1 through a water tank frame 510. Here, the water tank 500 is formed substantially in the shape of a rectangular parallelepiped, and is formed of a translucent material which is capable of retaining liquid. It should be noted that the water tank 500 according to the present embodiment is not restricted to such an arrangement. Rather, the water tank 500 may be formed in a desired shape, e.g., substantially in the shape of a cylinder. Also, various kinds of items for providing visual effects may be arranged within the water tank 500 (examples of which include simulated pirate ships, simulated tropical fish, and simulated aquatic plants, all of which can be moved by magnetic force).

In other words, the water tank 500 is provided behind the display screen that serves as a display means for displaying the indicating information. Here, the water tank 500 is a water tank capable of retaining liquid and is formed of a translucent material, for example.

Next, a description is provided regarding the structure of a movable liquid storage device 600 which partitions the water tank 500 so as to section off a portion of the liquid stored in the water tank 500, and the structure of an injection device 700 which injects a substance, which changes the color of the liquid stored in the water tank 500, into the liquid.

Figure 3:
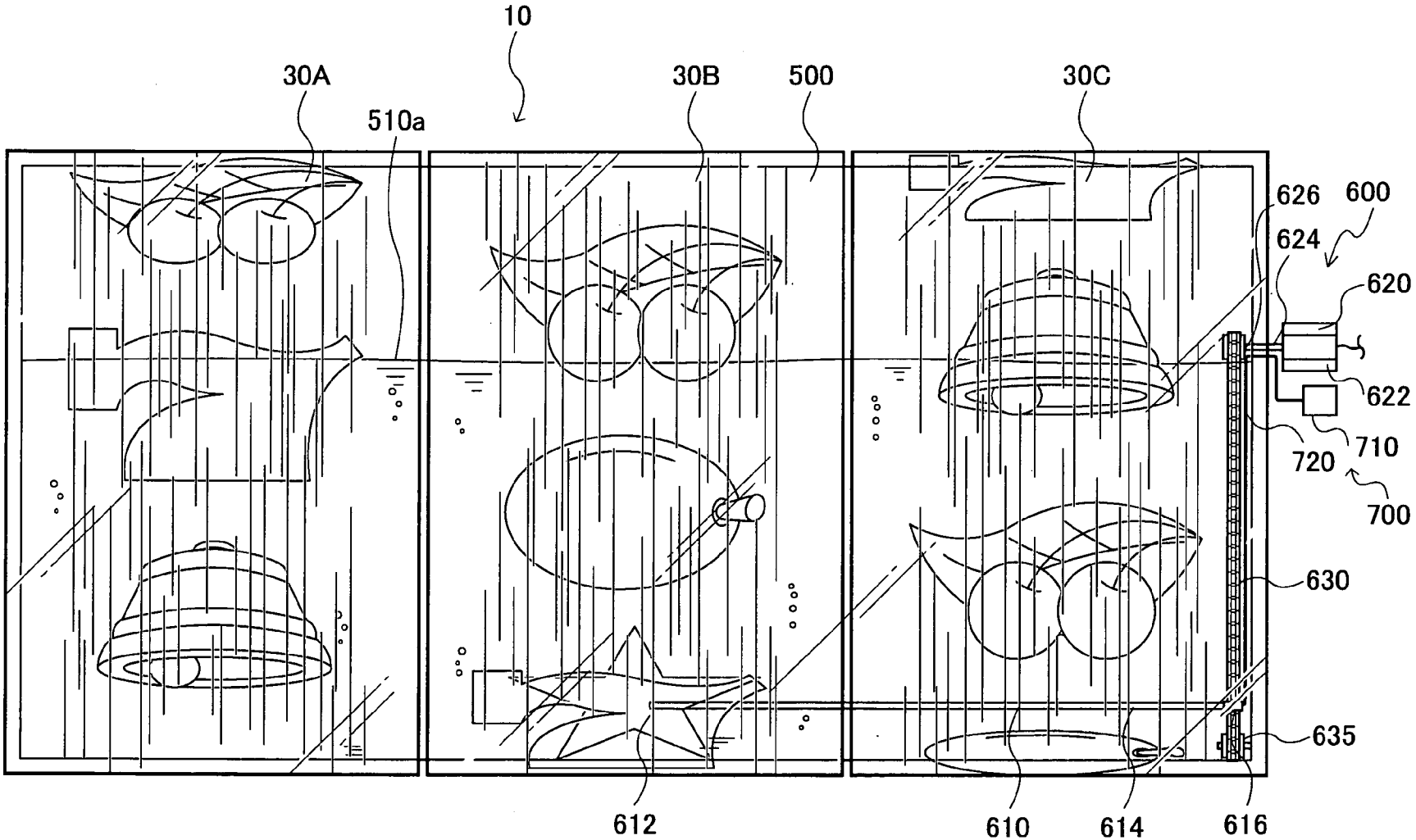
FIG. 3 is a front view showing a display screen for displaying mechanical reels, the water tank, a retaining device, and an insertion device, according to the first embodiment.
Figure 4:
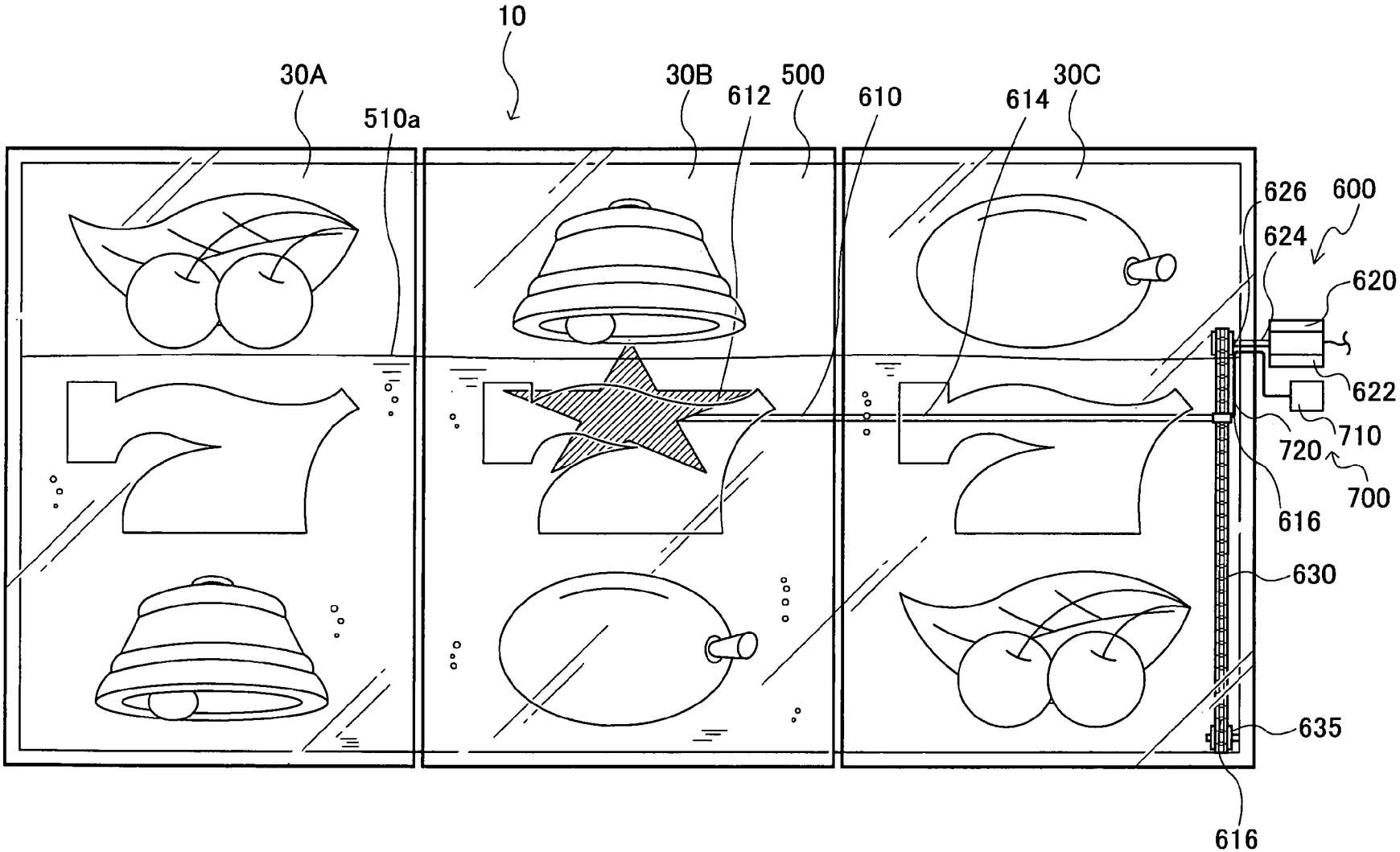
FIG. 4 is a front view showing the display screen for displaying the mechanical reels, the water tank, the retaining device, and the insertion device, according to the first embodiment.

FIG. 3 and FIG. 4 are front views showing the display screen 10 for displaying the mechanical reels 30A through 30C, the water tank 500, the liquid storage device 600, and the injection device 700, according to the first embodiment.

The liquid storage device 600 is provided within the liquid stored in the water tank 500. The liquid storage device 600 includes a motor 620, which moves the liquid storage unit 610, and a chain 630, which transmits the driving force of the motor 620 to the liquid storage unit 610.

The liquid storage unit 610 includes: a container 620 formed in a predetermined shape (e.g., in the shape of a star), which partitions the water tank 500 so as to section off a portion of the liquid stored in the water tank 500; a shaft portion 614 which extends from the end of the container 612; and a gear part 616 formed at the tip of the shaft portion 614. The container 612 stores a transparent and colorless acid-base indicator (e.g., a phenolphthalein ethanol solution, diluted with water).

The motor 620 is provided near the upper region of the side face of the water tank 500. The motor 620 includes: a motor main unit 622 which generates rotational driving force; a motor shaft 624 which transmits the rotational driving force generated by the motor main unit 622 to an external mechanism; and a motor gear part 626 provided at the tip of the motor shaft 624. The driving of the motor 620 is controlled by a drive control circuit 300 (see FIG. 5) described later.

The motor shaft 624 is rotatably disposed such that it passes through the side wall of the water tank 500. A rubber packing is provided to the portion where the motor shaft 624 passes through the side wall of the water tank 500, which maintains the waterproof condition of the water tank 500.

The chain 630 is formed in the shape of a ring. The chain 630 is wound around a pulley 635 that is rotatably provided at a region on the bottom side of the side wall of the water tank 500, and around the motor gear part 626 of the motor 620 that is provided near the upper region of the side wall of the water tank 500. Furthermore, the gear part 616 of the liquid storage unit 610 is engaged with an intermediate portion of the chain 630.

The injection device 700 includes: an acid/base solution supply device 710 for supplying an acid solution or a base solution (e.g., a sodium hydroxide solution); and a communicating part 720 which connects the acid/base solution supply device 710 and the liquid storage unit 610, thereby allowing the acid solution or the base solution supplied from the acid/base solution supply device 710 to be injected into the liquid storage unit 610. The communicating part 720 is formed of a flexible tube.

Next, a description is provided regarding the operations of the storage unit 600 and the injection device 700.

As shown in FIG. 3, multiple kinds of indicating information provided by the mechanical reels 30A through 30C are displayed on the display screen 10 variably. In this stage, the liquid storage unit 610 of the liquid storage device 600 is disposed on the bottom side of the water tank 500. Furthermore, in this stage, the injection device 700 supplies neither an acid solution nor a base solution. Accordingly, the liquid stored in the liquid storage unit 610 is in a transparent and colorless state. Next, as shown in FIG. 4, in a case in which the indicating information provided by the mechanical reels 30A through 30C are displayed on the display screen 10 in a predetermined special stationary state (e.g., the indicating information "red 7", "red 7", and "red 7" are rearranged in the stationary state), the motor 620 is driven and controlled by the drive control circuit 300 described later (see FIG. 5) such that it is rotationally driven in the right direction. This rotates the chain 630 in the right direction, whereby the liquid storage unit 610 engaged with the chain 630 through the gear part 616 is moved upward. On the other hand, upon rotationally driving the motor 620 in the left direction, the chain 610 is rotated in the left direction, thereby moving the liquid storage unit 610 downward. Furthermore, in this stage, the injection device 700 injects an acid solution or a base solution supplied from the acid/base solution supply device 710 into the liquid storage unit 610 via the communicating part 720. This changes the state of the liquid stored in the liquid storage unit 610 from the transparent and colorless state to a transparent and colored state. For example, a phenolphthalein ethanol solution diluted, with water, is employed as an acid-base indicator in the transparent and colorless state. On the other hand, a sodium hydroxide solution is employed as a base solution. With such an arrangement, upon injecting the base solution (sodium hydroxide solution) into the liquid storage unit 610, the state of the liquid stored in the liquid storage unit 610 changes from the transparent and colorless state to a transparent and pink-colored state.

In other words, the liquid storage device 600 is disposed within the water tank, and serves as an example of a movable liquid storage means which partitions the water tank so as to section off a portion of the liquid stored in the water tank. The acid/base solution supply device 710 serves as an example of an injection means for injecting a substance, which is capable of changing the color of the liquid stored in the water tank, into the liquid stored in the water tank.

Next, a description is provided regarding a configuration of the control device 100.

Figure 5:
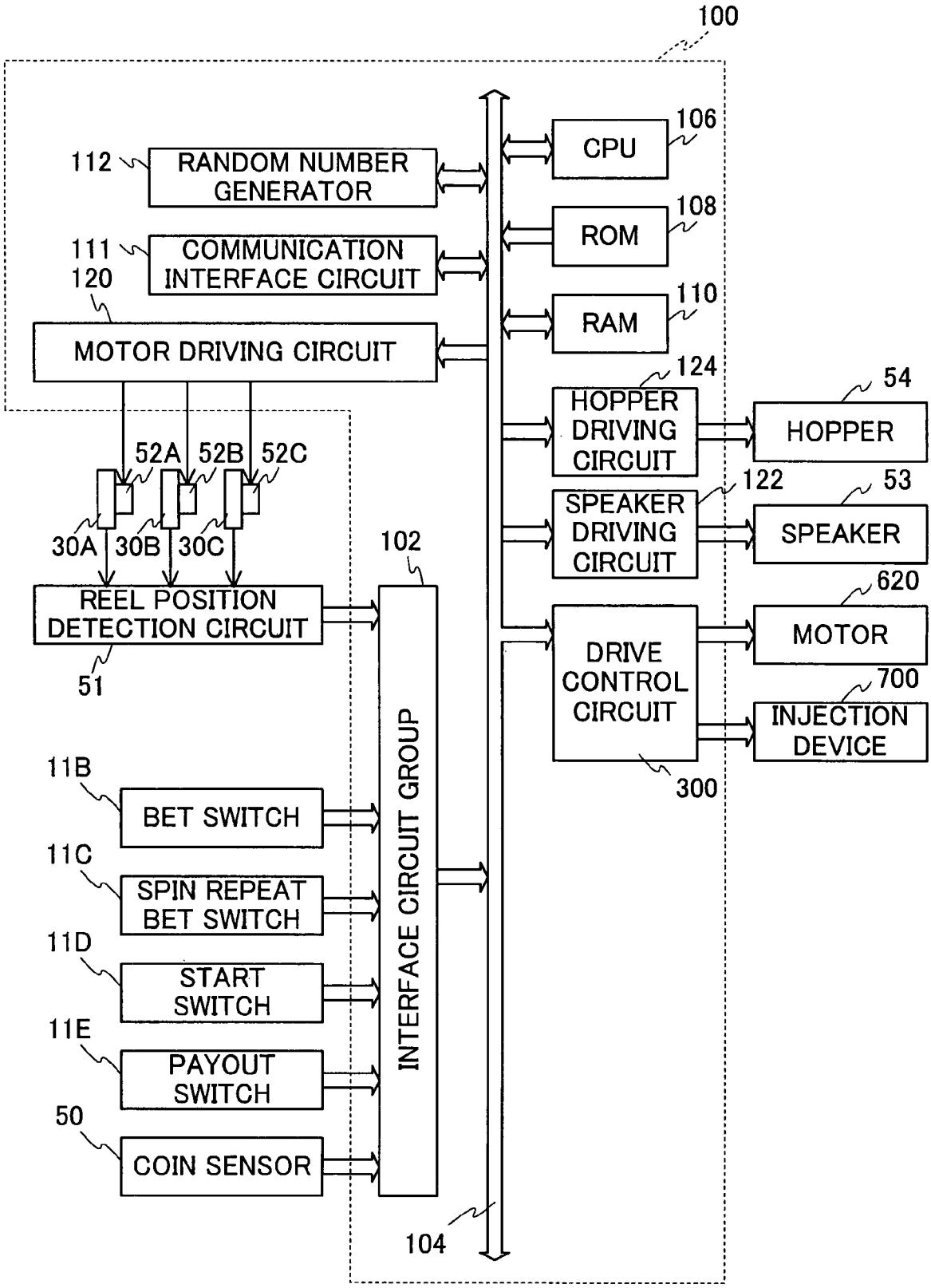
FIG. 5 is a block diagram showing an electrical configuration of a control device according to the first embodiment of the present invention.

FIG. 5 is a block diagram showing an electrical configuration of the control device 100 according to a first embodiment of the present invention.

The control device 100 is a microcomputer, and includes an interface circuit group 102, an input/output bus 104, a CPU 106, ROM 108, RAM 110, a communication interface circuit 111, a random number generator 112, a motor driving circuit 120, a speaker driving circuit 122, and a hopper driving circuit 124.

The interface circuit group 102 is connected to the input/output bus 104. Furthermore, the input/output bus 104 inputs and outputs data signals or address signals to and from the CPU 106.

The start switch 11D is connected to the interface circuit group 102. The start signal output from the start switch 11D is converted into a predetermined signal by the interface circuit group 102, and the start signal thus converted is sent to the input/output bus 104.

Furthermore, the BET switch 11B, the spin repeat BET switch 11C, and the payout switch 11E are connected to the interface circuit group 102. Each of the switching signals output from these switches 11B, 11C, and 11E is also sent to the interface circuit group 102, and is converted into a predetermined signal by the interface circuit group 102. The switching signals thus converted are sent to the input/output bus 104.

Furthermore, a coin sensor 50 is connected to the interface circuit group 102. The coin sensor 50 is a sensor for detecting the coins inserted into the coin insertion opening 11A. The coin sensor 50 is provided in combination with the coin insertion opening 11A. The sensing signal output from the coin sensor 50 is also sent to the interface circuit group 102, and is converted into a predetermined signal by the interface circuit group 102. The sensing signal thus converted is sent to the input/output bus 104.

Furthermore, a reel position detecting circuit 51 is connected to the interface circuit group 102. The reel position detecting circuit 51 is a circuit for detecting the rotational position for each of the mechanical reels 30A through 30C based upon the pulse signals received from a reel rotational position sensor (not shown). The detection signal output from the reel position detecting circuit 51 is also sent to the interface circuit group 102, and is converted into a predetermined signal by the interface circuit group 102. The detection signal thus converted is sent to the input/output bus 104.

Furthermore, the ROM 108 and the RAM 110 are connected to the input/output bus 104.

According to a program stored in the ROM 108, which is described later in detail, the CPU 106 controls the execution of a game provided by the slot machine 1.

The ROM 108 stores: a control program which centrally controls the slot machine 1; initialization data for executing the control program; and various data tables used in the lottery processing.

The RAM 110 temporarily stores flags, variables, etc., used for the aforementioned control program.

Furthermore, a communication interface circuit 111 is connected to the input/output bus 104. The communication interface circuit 111 is a circuit for communicating with a server, etc., via various kinds of communication networks including a public telephone line network, LAN, etc.

Furthermore, the random number generator 112 for generating a random number is connected to the input/output bus 104. The random number generator 112 generates a random number in a predetermined range, e.g., in a range of 0 and 65535. Alternatively, an arrangement may be made in which the CPU 106 generates a random number by computation.

A motor driving circuit 120 for driving the stepping motors 52A through 52C is connected to the input/output bus 104. The CPU 106 controls the operations of the stepping motors 52A through 52C via the motor driving circuit 120 according to the occurrence of predetermined events.

Furthermore, the speaker driving circuit 122 for driving the speaker 53 is connected to the input/output bus 104. The CPU 106 reads out the sound data stored in the ROM 108, and transmits the sound data thus read out to the speaker driving circuit 122 via the input/output bus 104, thereby providing predetermined sound effects generated by the speaker 53.

Furthermore, the hopper driving circuit 124 for driving the hopper 54 is connected to the input/output bus 104. Upon reception of a cash out signal input from the payout switch 11E, the CPU 106 transmits a driving signal to the hopper driving circuit 124 via the input/output bus 104. The hopper 54 then proceeds to pay out an amount of coins that corresponds to the credit remaining at the current point in time, as stored in a predetermined memory area of the RAM 110. In other words, the hopper 54 serves as an example of a payout means for paying out units of a gaming medium.

Furthermore, the drive control circuit 300 is connected to the input/output bus 104 for driving the motor 620 (see FIG. 3) of the liquid storage device 600. In a case where a predetermined event has occurred, the CPU 106 controls the operation of the motor 620 via the drive control circuit 300 so as to move the liquid storage unit 610 (see FIG. 3) of the liquid storage device 600.

In other words, the drive control circuit 300 serves as an example of a movement control circuit that performs a control operation which moves the liquid storage means.

Also, the drive control circuit 300 is connected to the input/output bus 104 for driving the injection device 700 (see FIG. 3). In a case where a predetermined event has occurred, the CPU 106 controls the acid/base solution supply device 710 so as to supply an acid solution or a base solution to the liquid storage unit 610 (see FIG. 3) via the communicating part 720.

Figure 6:
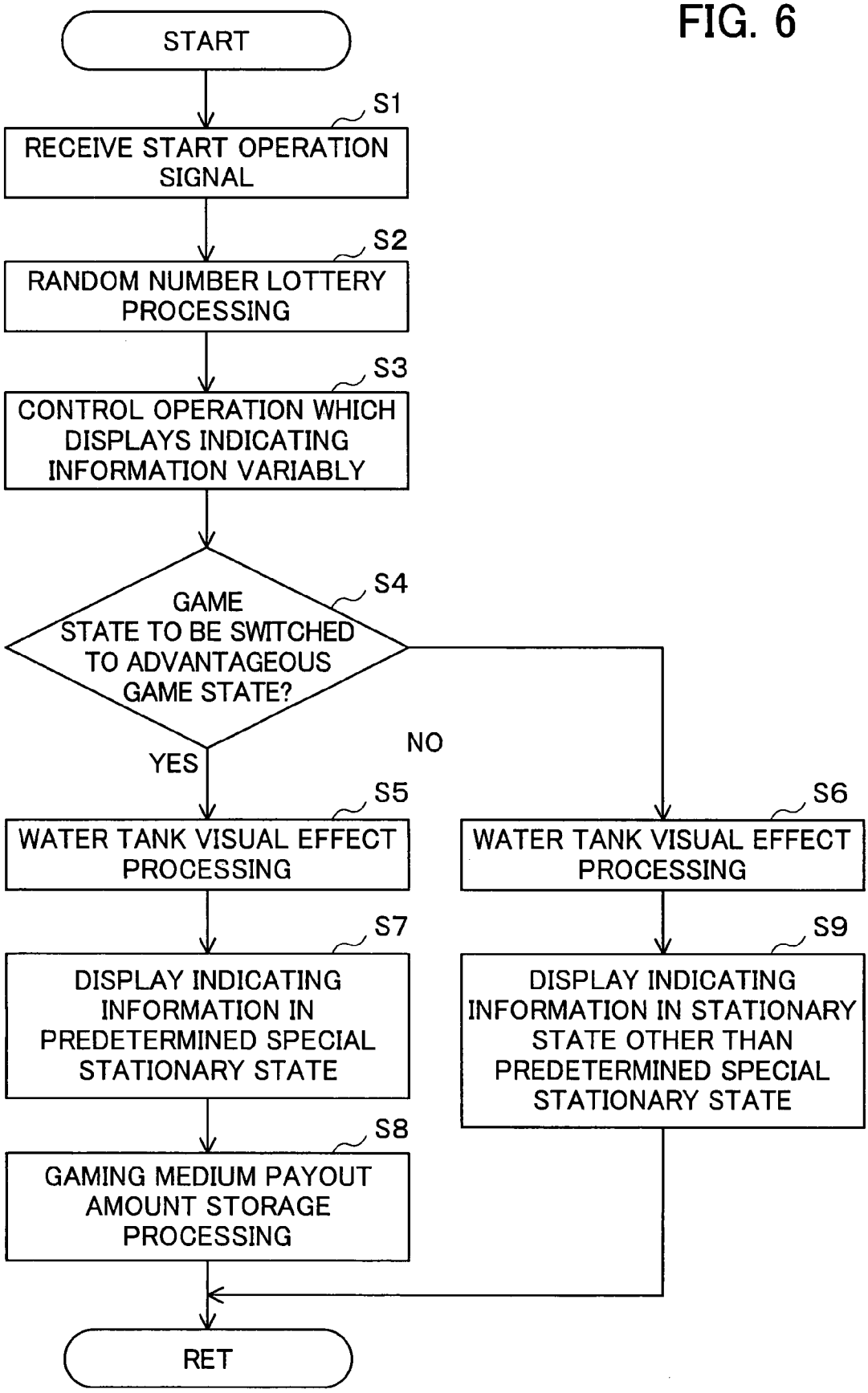
FIG. 6 is a flowchart for the game control means included in the slot machine according to the embodiment of the present invention.

Next, a description is provided regarding the operation of the CPU 106 that controls the execution of a game provided by the slot machine 1 according to the first embodiment with reference to a flowchart shown in FIG. 6.

In step S1, the CPU 106 receives a start operation signal. In this processing, upon the player performing a pushing operation on either the spin repeat BET switch 11C or the start switch 11D, a start operation signal is transmitted, upon which the CPU 106 receives the start operation signal thus transmitted. Upon completion of this processing, the CPU 106 switches the processing to step S2.

In step S2, the CPU 106 performs random number lottery processing. In this processing, the CPU 106 instructs the random number generator 112 to generate a random number, and extracts the random number thus generated. Upon completion of this processing, the CPU 106 switches the processing to step S3.

In step S3, the CPU 106 performs indicating information variable display control processing. In this processing, the CPU 106 transmits a command which instructs the motor driving circuit 120 to rotate the mechanical reels 30A through 30C. Upon reception of this command, the motor driving circuit 120 performs a control operation so as to rotate the mechanical reels 30A through 30C. In other words, the motor driving circuit 120 serves as an example of a display control means which is a rotational driving device for driving the reels. Upon completion of this processing, the CPU 106 switches the processing to step S4.

In step S4, the CPU 106 determines whether or not the game state is to be switched to an advantageous game state. In this processing, the CPU 106 determines whether or not the random number thus extracted in step S2 is within a predetermined range. In a case where the CPU 106 determines that the random number is within the predetermined range, the CPU 106 determines that the game state is to be switched to the advantageous game state, upon which the processing is switched to step S5. On the other hand, in a case where the CPU 106 does not determine that the random number is within the predetermined range, the CPU 106 determines that the game state is not to be switched to the advantageous game state, upon which the processing is switched to step S6.

In other words, the CPU 106 provides: a function as an operating means for allowing the player to operate the slot machine 1; and a function as an example of a game control means for determining, for every instance of the player performing an operation via the operating means, whether or not the game state is to be switched to the game state that is advantageous to the player.

The term "game state advantageous to the player" represents a state in which the following conditions are satisfied. First, in the processing in step S5 described later, the indicating information depicted on the mechanical reels 30A through 30C are displayed on the display screen 10 in a predetermined stationary display state (e.g., the indicating information "red 7", "red 7", and "red 7" are rearranged in the stationary display state). Second, in the processing in step S8 described later, a gaming medium payout amount is stored in a predetermined memory area of the RAM 110, which is used in payout processing in which a predetermined amount of the gaming medium is paid out.

In step S5 and step S6, the CPU 106 performs water tank visual effect control processing. In this processing, the CPU 106 controls the operation of the motor 620 via the drive control circuit 300 with reference to a water tank visual effect pattern table (see FIG. 7), thereby performing a control operation which moves the liquid storage unit 610 (see FIG. 3) of the liquid storage device 600. In addition, the CPU 106 controls the operation of the acid/base solution supply device 710 via the drive control circuit 300 such that an acid solution or a base solution supplied by the acid/base solution supply device 710 is injected into the liquid storage unit 610 (see FIG. 3) through the communicating part 720 (see FIG. 3) in stages according to the determination made in step S4 with reference to the water tank visual effect pattern table (see FIG. 7). After the completion of this processing, the CPU 106 switches the processing to step S7 or step S9.

In other words, the drive control circuit 300 serves as an example of a drive control means for controlling the injection means according to the determination made by the game control means. Also, the drive control circuit 300 serves as an example of the drive control means for performing a control operation which instructs the injection means to inject a substance, which is capable of changing the color of the liquid stored in the water tank, into the water tank in stages. Also, the drive control circuit 300 serves as an example of a movement control means for performing a control operation which moves the liquid storage means according to the determination made by the game control means.

In step S7, the CPU 106 performs a control operation so as to display the indicating information in a predetermined special stationary state. In this processing, the CPU 106 transmits a command which is an instruction to the motor driving circuit 120 to display the indicating information depicted on the mechanical reels 30A through 30C on the display screen 10 in a predetermined special stationary state (e.g., the indicating information "red 7", "red 7", and "red 7" are rearranged in the stationary state). Upon reception of this command, the motor driving circuit 120 performs a control operation so as to display the indicating information depicted on the mechanical reels 30A through 30C on the display screen 10 in the predetermined special stationary state (e.g., the indicating information "red 7", "red 7", and "red 7" are rearranged in the stationary state). Upon completion of this processing, the CPU 106 switches the processing to step S8.

In step S8, the CPU 106 performs gaming medium payout amount storage processing. In this processing, the CPU 106 stores the gaming medium payout amount, which is used in the processing in which a predetermined amount of the gaming medium is paid out, in a predetermined memory area of the RAM 110, according to the determination made in step S4 that the game state is to be switched to a special game state advantageous to the player. Upon completion of this processing, the CPU 106 ends one game.

In step S9, the CPU 106 performs a control operation which displays the indicating information in a stationary display state other than the predetermined special stationary display state. In this processing, the CPU 106 transmits a command to the motor driving circuit 120, which is an instruction to display the indicating information, which are provided by the mechanical reels 30A through 30C, on the display screen 10 in a stationary display state other than the predetermined special stationary display state (e.g., other than the state in which the indicating information "red 7", "red 7", and "red 7" are rearranged in the stationary display state). Upon reception of this command, the CPU 106 ends one game.

In other words, the CPU 106 serves as an example of a game control means which controls the execution of a game.

Next, a description is provided regarding the water tank visual effect pattern table used by the CPU 106 as a reference in the processing denoted by the aforementioned step S5 and step S6.

FIG. 7 shows the water tank visual effect pattern table. The water tank visual effect pattern table, which is stored in the ROM 108, specifies the relation between the probability that the game state will transit to an advantageous game state, the number of instances of injection of a substance (acid solution or base solution) to be performed by the acid/base solution supply device 710, and the distance by which the liquid storage unit 610 (see FIG. 3) is to be moved. Specifically, if the probability that the game state will transit to the advantageous game state is 100%, the number of instances of injection of the substance is 3; if the probability is 80%, this number is two; and if the probability is 30%, this number is one. In addition, if the probability that the game state will transit to the advantageous game state is 100%, the distance by which the liquid storage unit 610 is to be moved is 100; if the probability is 80%, this distance is 80; and if the probability is 30%, this distance is 30. With such an arrangement, an acid solution or a base solution is inserted into an acid-base indicator in stages, thereby allowing the depth of the color of the liquid stored in the liquid storage unit 610 to be changed in stages.

The first embodiment provides the following advantages.

(1) When the player performs an operation on either the spin repeat BET switch 11C or the start switch 11D, the CPU 106 determines whether or not the game state is to be switched to a special game state advantageous to the player. The mechanical reels 30A through 30C, each of which is formed of a translucent material, provide a function of displaying multiple kinds of indicating information variably and statically. According to the determination made by the CPU 106, the motor driving circuit 120 controls the display operation of the mechanical reels 30A through 30C on which multiple kinds of indicating information are displayed variably and statically. The water tank 500, which retains liquid and is formed of a translucent material, is provided behind the display screen 10 for displaying the indicating information provided on the mechanical reels 30A through 30C.

With such an arrangement, the drive control circuit 300 controls the acid/base solution supply device 710 according to the determination made by the CPU 106, which provides a function of injecting into the water tank 500 a substance that is capable of changing the color of the liquid stored in the water tank 500.

With such an arrangement, the water tank 500, which retains liquid, is provided behind the mechanical reels 30A through 30C that display multiple kinds of indicating information variably and statically. Such an arrangement allows the player to simultaneously recognize the multiple kinds of indicating information, which are provided on the mechanical reels 30A through 30C and are displayed on the display screen 10, and the water tank 500 provided behind the display screen 10. With such an arrangement, there is no need to take into account a concern of whether or not the water tank 500 interrupts the player's view of the display screen 10 that displays the indicating information depicted on the mechanical reels 30A through 30C. Thus, with such an arrangement, the depth dimension of the water tank 500 can be greater when compared with an arrangement in which the water tank 500 is provided forward of the mechanical reels 30A through 30C. Various kinds of items which provide visual effects (e.g., simulated pirate ships, simulated tropical fish, and simulated aquatic plants, all of which can be moved by magnetic force) can be arranged within such a water tank 500 thus designed.

Furthermore, such an arrangement provides: a function of displaying the indicating information provided on the mechanical reels 30A through 30C variably and statically according to the determination made by the CPU 106 of whether or not the game state is to be switched to a special game state advantageous to the player; and a function of changing the color of the liquid stored in the water tank 500 according to this determination. With such an arrangement, an acid-base indicator is dissolved in the liquid stored in the water tank 500. The acid/base solution supply device 710 injects an acid solution or a base solution into the liquid, thereby allowing the color of the liquid stored in the water tank 500 to be changed. Thus, with such an arrangement, visual effects, including the display of indicating information variably and statically, and the change in the color of the liquid stored in the water tank 500, are displayed in a superimposed manner. The player is thereby provided with notice that the game state will transit to an advantageous game state, which is of great interest to the player. This improves visual effects provided by the water tank 500.

Thus, such an arrangement provides improved visual effects by using the water tank 500, while facilitating the player's ability to visually recognize the information displayed by the mechanical reels 30A through 30C.

(2) The drive control circuit 300 performs a control operation which instructs the acid/base solution supply device 710 to inject into the water tank 500 in stages a substance that is capable of changing the color of the liquid stored in the water tank 500.

Such an arrangement allows the color of the liquid stored in the water tank 500 to be changed in stages. Thus, such an arrangement changes the color of the liquid stored in the water tank 500 in stages according to the determination of whether or not the game state is to be switched to a special game state advantageous to the player.

With such an arrangement, an acid-base indicator is dissolved in the liquid stored in the water tank 500. The acid/base solution supply device 710 injects an acid solution or a base solution into the water tank 500. The CPU 106 determines by random number lottery whether or not the game state is to be switched to a special game state advantageous to the player, upon which the drive control circuit 300 performs a control operation which instructs the acid/base solution supply device 710 to inject an acid solution or a base solution into the liquid stored in the water tank 500 in stages according to the determination of whether or not the game state is to be switched to a special game state advantageous to the player. The ROM 108 is provided for storing the water tank visual effect pattern table that specifies the relation between the probability that the game state will transit to the advantageous game state, which is used in the random number lottery processing, and the number of instances of the injection of an acid solution or a base solution. In the water tank visual effect pattern table, the number of instances of the injection of an acid solution or a base solution is proportional to the probability that the game state will transit to the advantageous game state. With such an arrangement, the number of instances of the change in the color of the liquid stored in the water tank 500 is increased as the probability that the game state will transit to the advantageous game state becomes higher. With such an arrangement, the number of instances of the change in the color of the liquid stored in the water tank 500 further enhances the player's sense of expectation with respect to the game state transition to the special game state advantageous to the player.

Thus, such an arrangement provides improved visual effects by using the water tank 500, while facilitating the player's ability to visually recognize the information provided by the mechanical reels 30A through 30C.

(3) The liquid storage device 600 is a movable device which partitions the water tank 500 so as to section off a portion of the liquid stored in the water tank 500. The drive control circuit 300 performs a control operation which instructs the liquid storage device 600 to move the liquid storage unit 610 communicating with the acid/base solution supply device 710 through the communicating part 720.

Such an arrangement allows the color of the liquid stored in the liquid storage unit 610 of the liquid storage device 600 to be changed, and allows the liquid storage unit 610 to be moved. Thus, such an arrangement provides a function of changing the color of the liquid stored in the liquid storage unit 610 of the liquid storage device 600 and moving the liquid storage unit 610 according to the determination of whether or not the game state is to be switched to a special game state advantageous to the player.

With such an arrangement, an acid-base indicator is dissolved in the liquid stored in the water tank 500. The injection means injects an acid solution or a base solution into the liquid storage device 600. The ROM 108 is provided which stores a water tank visual effect pattern table that specifies the correspondence between the probability that the game state will transit to the advantageous game state, which is used in the random number lottery processing, the number of instances of the injection of an acid solution or a base solution, and the movement pattern of the liquid storage device 600. With such an arrangement, determination is made in the acid/base solution supply device 710 by random number lottery whether or not the game state is to be switched to a special game state advantageous to the player, upon which the drive control circuit 300 performs a control operation which instructs the injection means to inject an acid solution or a base solution into the liquid stored in the water tank in stages according to the determination of whether or not the game state is to be switched to a special game state advantageous to the player with reference to the visual effect pattern table. Furthermore, the drive control circuit 300 performs a control operation which moves the liquid storage device 600 according to the movement pattern determined with reference to the water tank visual effect pattern table according to the determination of whether or not the game state is to be switched to a special game state advantageous to the player. With such an arrangement, the number of instances of the change in the color of the liquid stored in the water tank 500 and the position of the liquid storage device 600 storing the liquid in this color thus changed further enhances the player's sense of expectation with respect to the game state transition to the special game state advantageous to the player.

Thus, such an arrangement provides improved visual effects by using the water tank 500, while facilitating the player's ability to visually recognize the information provided by the mechanical reels 30A through 30C.

Second Embodiment

In the following description of a second embodiment, the same components as those in the first embodiment are denoted by the same reference numerals, and descriptions thereof are omitted or simplified.

Figure 8:
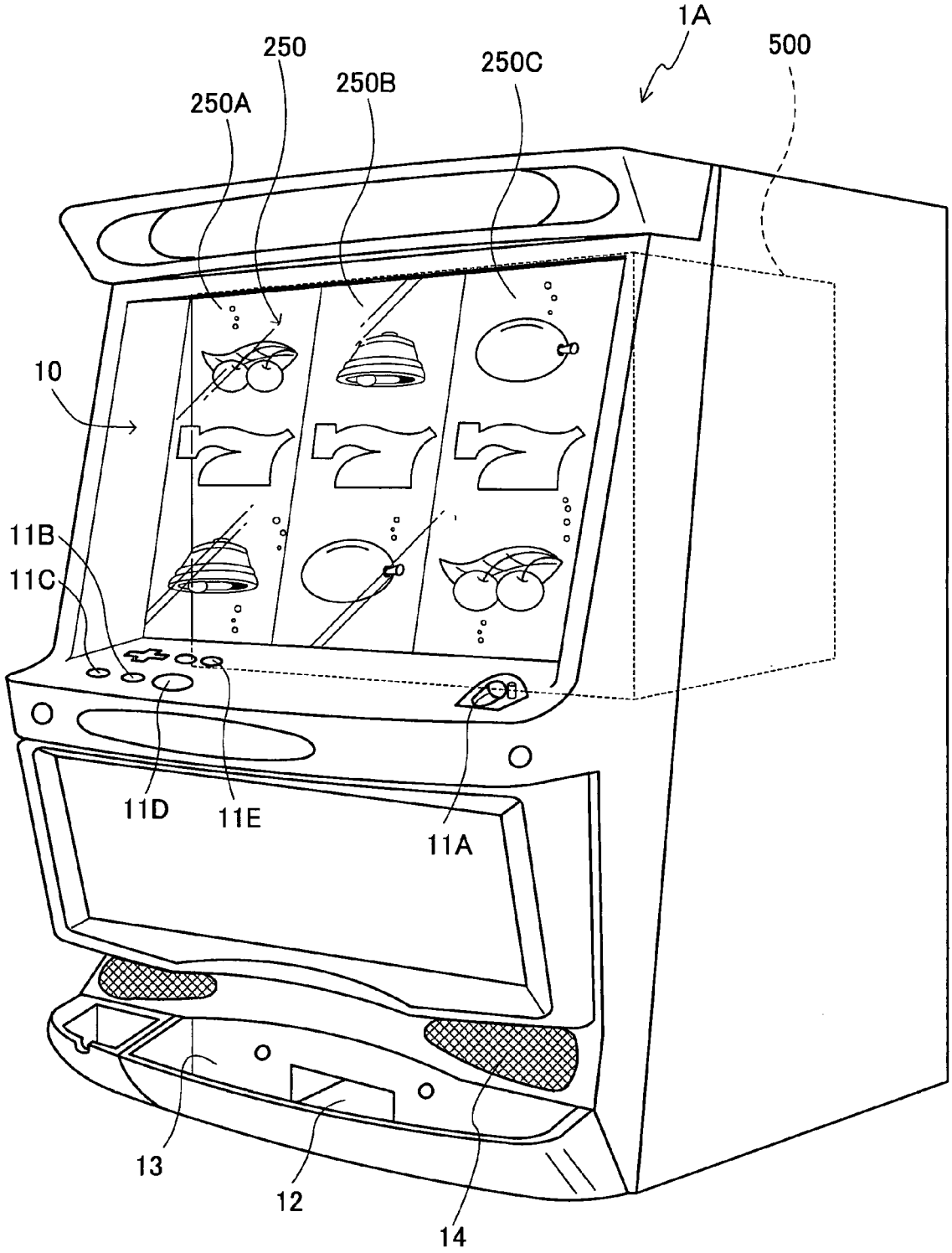
FIG. 8 is a perspective view showing the exterior of a slot machine according to a second embodiment of the present invention.

FIG. 8 is a perspective view showing the exterior of a slot machine 1A according to the second embodiment of the present invention.

Figure 9:
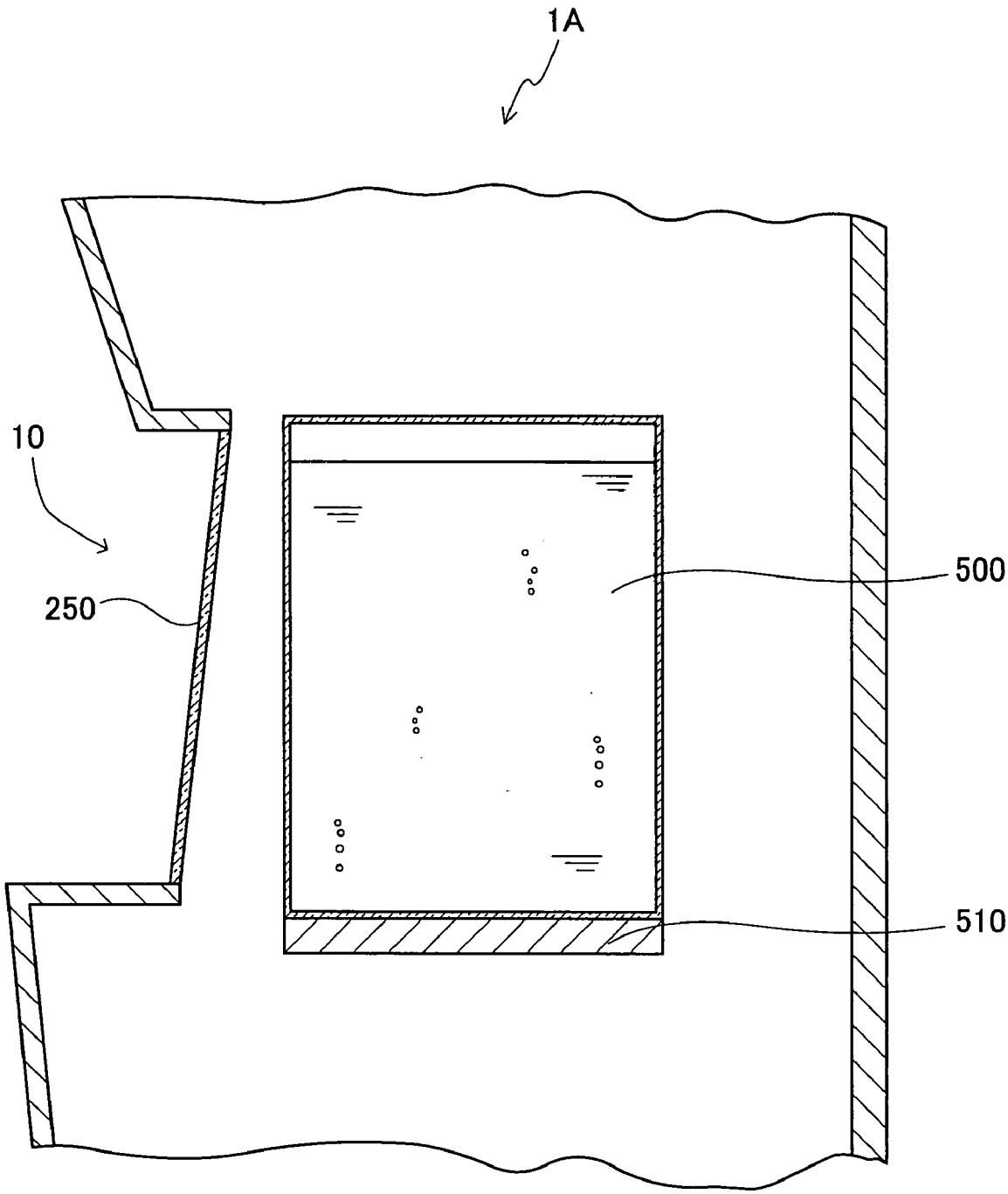
FIG. 9 is a cross-sectional view showing a liquid crystal display device and a water tank included in the slot machine according to the second embodiment of the present invention.

FIG. 9 is a cross-sectional view of a liquid crystal display device 250 and the water tank 500 included in the slot machine 1A according to the second embodiment of the present invention.

The slot machine 1A according to the second embodiment includes the liquid crystal display device 250 instead of the mechanical reels 30A through 30C included in the first embodiment, which is a point of difference from the first embodiment.

Furthermore, the slot machine 1A according to the second embodiment includes a display control device 200 instead of the motor driving circuit 120 included in the first embodiment, which is another point of difference from the first embodiment.

The liquid crystal display device 250 is provided forward of the water tank 500, and has a function of displaying multiple kinds of indicating information on three indicating information display regions 250A through 250C variably and statically. Here, each of the three indicating information display regions 250A through 250C has a configuration in which a transparent substrate such as a glass substrate, upon which a thin film transistor layer has been formed, and another transparent substrate are mounted so as to face each other with a certain gap between them, and the gap between the substrates is filled with a liquid crystal.

In other words, the liquid crystal display device 250 is provided forward of the water tank, and serves as an example of a liquid crystal display device which provides a function of displaying the indicating information variably and statically.

Figure 10:
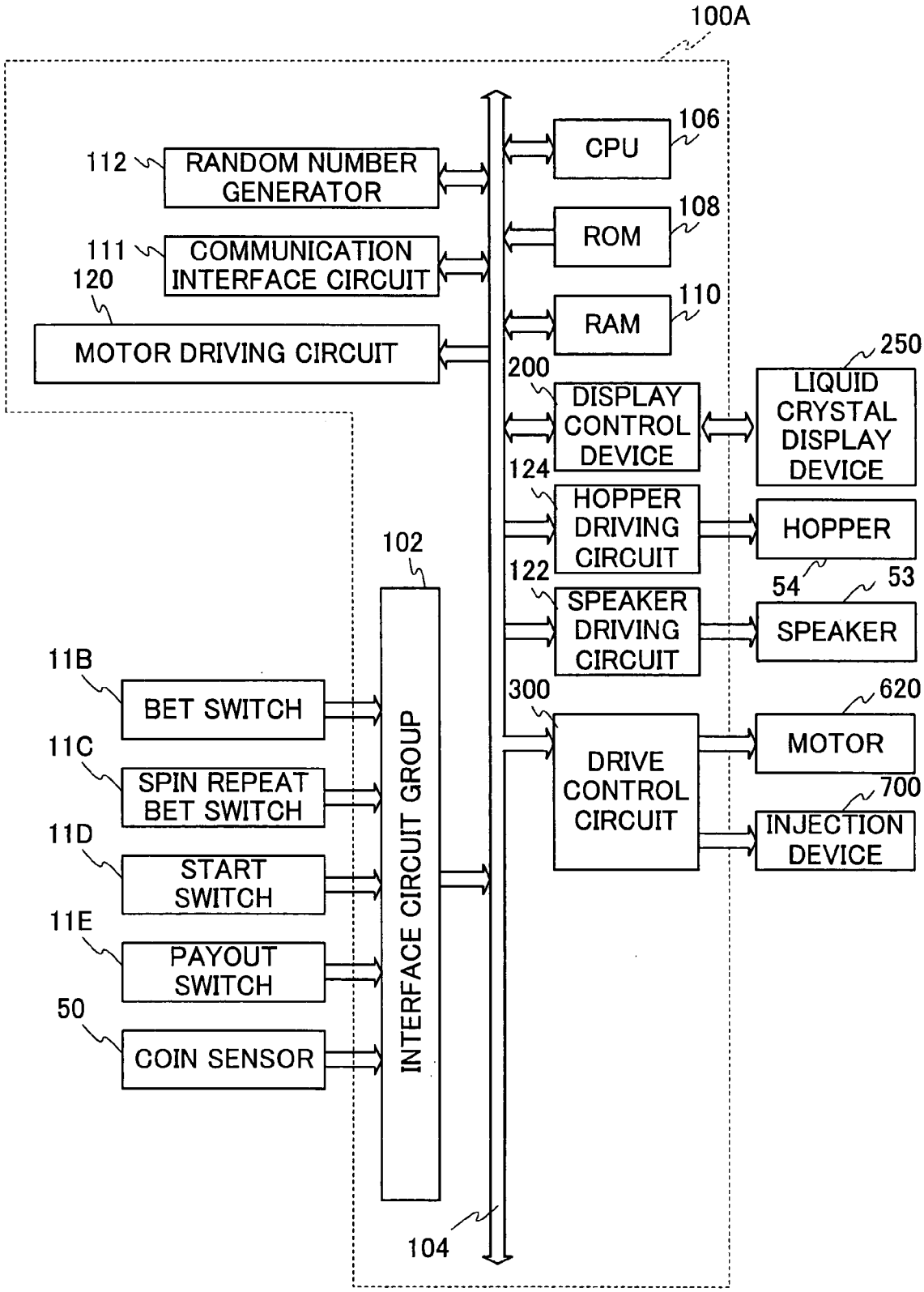
FIG. 10 is a block diagram showing an electrical configuration of a control device according to the second embodiment of the present invention.

FIG. 10 is a block diagram showing an electrical configuration of a control device 100A according to the second embodiment of the present invention.

The display control device 200 is connected to the input/output bus 104. The CPU 106 generates an image display command corresponding to the state and results of the game, and outputs the image display command thus generated to the display control device 200 via the input/output bus 104. Upon reception of the image display command as an input signal from the CPU 106, the display control device 200 generates a drive signal for driving the liquid crystal display device 250 according to the image display command thus received. Then, the display control device 200 outputs the drive signal thus generated to the liquid crystal display device 250. With such an arrangement, the liquid crystal display device 250 provides a function of displaying multiple kinds of indicating information on the indicating information display regions 250A through 250C variably and statically.

In other words, the display control device 200 serves as an example of a display control means which is a display control circuit that controls the liquid crystal display device.

Next, a description is provided regarding the processing performed by the CPU 106, which executes a game provided by the slot machine 1 according to the second embodiment with reference to the flowchart shown in FIG. 6.

The processing denoted by step S1 and the processing denoted by step S2 are the same as those in the first embodiment.

In step S3, the CPU 106 performs indicating information variably display control processing. In this processing, the CPU 106 transmits a command to the display control device 200, which instructs the liquid crystal display device 250 to display the multiple kinds of indicating information variably. Upon reception of this command, the display control device 200 performs a control operation so as to display the multiple kinds of indicating information on the indicating information display regions 250A through 250C of the liquid crystal display device 250 variably. Upon completion of this processing, the CPU 106 switches the processing to step S4.

The processing denoted by step S4 through step S6 is the same as that in the first embodiment.

In step S7, the CPU 106 performs a control operation so as to display the indicating information in a predetermined special stationary state. In this processing, the CPU 106 transmits a command to the display control device 200, which instructs the liquid crystal display device 250 to display the multiple kinds of indicating information in the predetermined special stationary state (e.g., the indicating information "red 7", "red 7", and "red 7" are rearranged in the stationary state). After the multiple kinds of indicating information have been displayed on the indicating information display regions 250A through 250C of the liquid crystal display device 250 variably, upon reception of this command, the display control device 200 performs a control operation so as to display the indicating information in the predetermined special stationary state (e.g., the indicating information "red 7", "red 7", and "red 7" are rearranged in the stationary state). Upon completion of this processing, the CPU 106 switches the processing to step S8.

The processing denoted by step S8 is the same as that in the first embodiment.

In step S9, the CPU 106 performs a control operation so as to display the indicating information in a stationary state other than the aforementioned predetermined special state. In this processing, the CPU 106 transmits a command to the display control device 200, which instructs the liquid crystal display device 250 to display the indicating information in a stationary state other than the aforementioned predetermined special stationary state (e.g., a state other than the indicating information "red 7", "red 7", and "red 7" are rearranged in the stationary state) after the multiple kinds of indicating information have been displayed variably. Upon reception of this command, the display control device 200 performs a control operation so as to display the indicating information on the indicating information display regions 250A through 250C of the liquid crystal display device 250 in a stationary state other than the special stationary state after multiple kinds of indicating information have been displayed variably. Upon completion of this processing, the CPU 106 ends one game.

The second embodiment provides the following advantage.

The liquid crystal display device 250, which is provided forward of the water tank 500, is employed as a display means. Furthermore, the display control device 200, which controls the liquid crystal display device 250, is employed as a display control means.

Such an arrangement allows the indicating information to be displayed variably and statically using various images. Furthermore, with such an arrangement, the liquid crystal display device 250 is formed of a translucent material, and is provided forward of the water tank 500. Such an arrangement allows the indicating information and the water tank to be displayed in a superimposed manner.

Thus, such an arrangement provides improved visual effects by using the water tank, while facilitating the player's ability to visually recognize the information displayed by the display means.

The embodiments according to the present invention have been described above with reference to specific examples for exemplary purpose only, and it should be clearly understood that the embodiments in no way restrict the present invention. That is to say, the gaming machine according to the present invention principally includes: an operating means for allowing the player to operate the gaming machine; a game control means having a function whereby, upon the player performing an operation on the operating means, determination is made whether or not the game state is to be switched to a special game state advantageous to the player; a display means for displaying multiple kinds of indicating information variably and statically that is formed of a translucent material; a display control means for controlling, according to the determination made by the game control means, the display operation of the display means for displaying the indicating information variably and statically; a water tank provided behind the display screen for displaying the indicating information provided by the display means, which retains liquid containing an acid-base indicator, and is formed of a translucent material; an injection means for injecting into the liquid stored in the water tank a substance which is capable of changing the color of the liquid; and a drive control means for controlling the injection means according to the determination made by the game control means. With such an arrangement, the specific components such as the operating means, the game control means, the display means, the display control means, the water tank, the injection means, the drive control means, etc., may be modified and altered as suitable.

Moreover, it should be noted that the advantages described in association with the embodiments of the present invention are merely a listing of most preferred advantages of the present invention, and that the advantages of the present invention are by no means restricted to those described in connection with the embodiments of the present invention.

While preferred embodiments of the present invention have been described and illustrated above, it is to be understood that they are exemplary of the invention and are not to be considered to be limiting. Additions, omissions, substitutions, and other modifications can be made thereto without departing from the spirit or scope of the present invention. Accordingly, the invention is not to be considered to be limited by the foregoing description and is only limited by the scope of the appended claims.

EXPLANATION OF THE REFERENCE SYMBOLS

1, 1A: slot machine
10: display screen
11: operation panel
12: coin payout opening
13: coin tray
14: sound output unit
30: reel group
30A to 30E: mechanical reel
100: control device
102: interface circuit group
104: input/output bus
106: CPU
108: ROM
110: RAM
111: communication interface circuit
112: random number generator
120: motor driving circuit
122: speaker driving circuit
124: hopper driving circuit
128: display unit driving circuit
200: display control device
250: liquid crystal display device
300: drive control circuit
500: water tank
600: retaining device
700: injection device

What is claimed is:

1. A gaming machine comprising:

an operating device for allowing a player to operate the gaming machine;

a game control device for making a determination of whether or not a game state is to be switched to a special game state advantageous to the player, upon the player performing an operation on the operating device;

a display device for displaying a plurality of kinds of indicating information variably and statically, that is formed of a translucent material;

a display control device for controlling, according to the determination made by the game control device, a display operation of the display device for displaying the indicating information variably and statically;

a water tank which is provided behind a display screen for displaying the indicating information provided by the display device, retains liquid, and is formed of a translucent material;

an injection device for injecting a substance, which is capable of changing the color of the liquid stored in the water tank, into the liquid; and a drive control device for controlling the injection device according to the determination made by the game control device.

2. A gaming machine according to claim 1, wherein the drive control device instructs the injection device to inject the substance, which is capable of changing the color of the liquid stored in the water tank, into the liquid in stages.

3. A gaming machine according to claim 1, further comprising:

a liquid storage device, which is movably provided within the water tank such that it partitions the water tank so as to section off a portion of the liquid stored in the water tank, for storing the portion of the liquid thus sectioned off;

a movement control device for controlling the movement of the liquid storage device; and a communicating device for allowing the injection device and the liquid storage device to communicate with each other, wherein the movement control device controls the movement of the liquid storage device according to the determination made by the game control device.

4. A gaming machine according to claim 2, further comprising:

a liquid storage device, which is movably provided within the water tank such that it partitions the water tank so as to section off a portion of the liquid stored in the water tank, for storing the portion of the liquid thus sectioned off;

a movement control device for controlling the movement of the liquid storage device; and a communicating device for allowing the injection device and the liquid storage device to communicate with each other, wherein the movement control device controls the movement of the liquid storage device according to the determination made by the game control device.

* * * * *